US006745469B1

(12) United States Patent
Soik et al.

(10) Patent No.: US 6,745,469 B1
(45) Date of Patent: Jun. 8, 2004

(54) METHOD OF MAKING SCREEN MEDIA AND A SCREENING PASSAGE THEREFORE

(75) Inventors: Matthew R. Soik, Muskego, WI (US); Mark S. Lutz, West Allis, WI (US); Dennis G. Purton, Pewaukee, WI (US)

(73) Assignee: J&L Fiber Services, Inc., Waukesha, WI (US)

( * ) Notice: Subject to any disclaimer, the term of this patent is extended or adjusted under 35 U.S.C. 154(b) by 0 days.

(21) Appl. No.: 09/703,434

(22) Filed: Oct. 30, 2000

Related U.S. Application Data

(62) Division of application No. 09/086,902, filed on May 29, 1998, now Pat. No. 6,138,838.

(51) Int. Cl.[7] ..... B23P 15/00

(52) U.S. Cl. ..... 29/896.62; 29/896.6; 29/896.61

(58) Field of Search ..... 29/896.6, 896.61, 29/896.62; 162/55, 251, 261; 209/250, 273, 306, 397, 393, 300; 210/415, 497.01

(56) References Cited

U.S. PATENT DOCUMENTS

| | | | | |
|---|---|---|---|---|
| 87,385 A | | 3/1869 | Winchester | |
| 105,755 A | * | 7/1870 | Winchester | 29/896.62 |
| 239,837 A | | 4/1881 | Pinder et al. | |
| 1,311,160 A | * | 7/1919 | French | 29/896.6 |
| 1,467,759 A | | 9/1923 | Hall | |
| 1,596,775 A | | 8/1926 | Stephansen | |
| 2,301,514 A | * | 11/1942 | Brewster | |
| 3,387,708 A | | 6/1968 | Salomon et al. | |
| 3,617,008 A | | 11/1971 | Lamort | 241/88 |
| 3,664,502 A | | 5/1972 | Nichols, Jr. | |
| 3,748,428 A | | 7/1973 | Nichols, Jr. | 219/69 |
| 4,213,823 A | | 7/1980 | Wittig et al. | |
| 4,316,768 A | | 2/1982 | Goddard | |
| 4,348,284 A | | 9/1982 | Peer et al. | |
| 4,396,502 A | | 8/1983 | Justus | |
| 4,462,900 A | | 7/1984 | Matthew | |
| 4,538,734 A | | 9/1985 | Gill | |
| 4,657,079 A | | 4/1987 | Nagaoka | |
| 4,663,030 A | | 5/1987 | Chupka et al. | |

(List continued on next page.)

FOREIGN PATENT DOCUMENTS

| | | | |
|---|---|---|---|
| CA | 2178683 | | 4/1997 |
| CN | 68403 | * | 2/1994 |
| DE | 25 33 240 A1 | | 2/1976 |
| EP | 0 651 091 A1 | | 5/1995 |
| JP | 86-282777/43 | | 3/1985 |
| WO | WO 82/02345 | | 7/1982 |
| WO | WO 96/37655 | | 11/1996 |
| WO | WO 98/14658 | | 4/1998 |

OTHER PUBLICATIONS

J & L Fiber Services, BelWave™ Screen Cylinder detail sheets, 4/98.

J & L Fiber Services, OptiGuard™ CSC Continuous Slotted Cylinders detail sheets, 11/97.

J & L Fiber Services, RSC™ Screen Cylinders detail sheet, 12/97.

*Primary Examiner*—I Cuda Rosenbaum
(74) *Attorney, Agent, or Firm*—Boyle, Fredrickson, Newholm, Stein & Gratz, S.C.

(57) ABSTRACT

A screen media (200) for use in screening pulp slurry has a first side (204) and a second side (206). The pulp slurry is fed from the first side of the screen media to the second side of said screen media through a plurality of screening passages (205). Each said screening passage include a contour cut (210) formed in the first side, a back groove (208) formed in the second side, and a residual thickness (234) between the contour cut and the back groove. An elongate slot (235) is formed in the residual material, and the residual thickness has a substantially uniform thickness about the elongate slot. Where the slot extends completely through the residual material it defines a through-slit (236) through which slurry flows and is filtered.

56 Claims, 5 Drawing Sheets

U.S. PATENT DOCUMENTS

| | | | | |
|---|---|---|---|---|
| 4,699,324 | A | 10/1987 | Ahs | |
| 5,587,077 | A | 12/1996 | Aaltonen et al. | 210/498 |
| 5,605,234 | A | 2/1997 | Aikawa | 209/411 |
| 5,607,589 | A | 3/1997 | Frejborg | 210/415 |
| 5,624,558 | A | 4/1997 | Aaltonen et al. | 210/415 |
| 5,647,128 | A | 7/1997 | Aikawa | 29/896.62 |
| 5,718,826 | A | 2/1998 | Frejborg | 210/402 |
| 5,727,316 | A | 3/1998 | Riendeau | 29/896.62 |
| 5,791,495 | A | 8/1998 | Gero et al. | 209/395 |
| 5,799,798 | A | 9/1998 | Chen | 209/306 |
| 5,954,956 | A | 9/1999 | Lutz et al. | 210/232 |
| 6,021,905 | A | 2/2000 | Frejborg | 209/411 |
| 6,051,103 | A | 4/2000 | Aikawa | 162/55 |
| 6,119,867 | A | 9/2000 | Ljokkoi et al. | 209/273 |
| 6,138,838 | A | 10/2000 | Soik et al. | 210/415 |
| 6,257,413 | B1 | 7/2001 | Tolvanen | 209/407 |
| 6,284,145 | B1 | 9/2001 | Andersson | 210/767 |
| 6,344,112 | B1 | 2/2002 | Hernesniemi | 162/251 |

* cited by examiner

METHOD OF MAKING SCREEN MEDIA AND A SCREENING PASSAGE THEREFORE

CROSS-REFERENCE TO RELATED APPLICATION

This application is a divisional of U.S. patent application Ser. No. 09/086,902 that was filed on May 29, 1998, and which issued Oct. 31, 2000 as U.S. Pat. No. 6,138,838.

BACKGROUND OF THE INVENTION

1. Field of the Invention

The present invention relates generally to screens for use in screening or filtering, such as in papermaking processes, wood pulp and other fibrous or particulate fluid suspensions for removing foreign particles therefrom, and more particularly, to a screen media and a screening passage for a screen media.

2. Description of the Relevant Art

Most paper today is made on Fourdrinier machines patterned after the first successful papermaking machine, which was developed in the early years of the 19th century. The heart of the Fourdrinier machine is an endless belt of wire mesh that moves horizontally over a number of rolls. A flow of watery paper pulp from a head box at the beginning of the papermaking machine is spread on the level moving belt. Water passing through the belt is collected and is remixed with the pulp to salvage the fiber contained in it. Spreading of the sheet of wet pulp on the wire belt is limited by rubber deckle straps moving at the sides of the belt. Suction pumps beneath the belt hasten drying of the paper, and the belt itself is agitated from side to side to aid the felting of the paper fibers. As the paper travels along the belt it passes under a rotating cylinder called a dandy roll. The surface of this cylinder is covered with wire mesh or single wires to impart a wove or laid surface to the paper. In addition, the surface may carry words or patterns worked in wire; these are impressed in the paper and appear as watermarks that identify the grade of paper and the maker.

Near the far end of the machine, the belt passes through two felt-covered couch rolls. These rolls press still more water out of the fibrous web and consolidate the fiber, giving the paper enough strength to continue through the machine without the support of the belt. From the couch rolls, the paper is carried on a belt of cloth through two sets of smooth metal press rolls. These rolls impart a smooth finish to the upper and lower surface of the paper. After pressing, the paper is fully formed. Thereafter, the paper is carried through a series of heated rolls that complete the drying. The next step is calendering, pressing between smooth chilled rolls to impart on the paper a smooth finish known as a machine finish.

The first step in machine papermaking is thus the preparation of the pulp from raw material. The raw materials chiefly used in modem papermaking are cotton or linen rags and wood pulp. Today more than 95 percent of paper is made from wood cellulose. For the cheapest grades of paper, such as newsprint, ground wood pulp alone is used; for better grades, chemical wood pulp, or a mixture of pulp and rag fiber is employed; and for the finest papers, such as the highest grades of writing papers, rag fiber alone is used.

There are several processes for the preparation of fibers from rags, wood and combinations thereof. In each process, several filtering steps are required for separating useable fiber from unusable fiber and contaminants. For example, a typical preparation operation employs three stages of filtering, or screening. However, depending on the starting material and/or the desired purity and composition of fibers, more or less stages of screening may be employed. Also, upstream processing to prepare raw fiber material may employ one or more screening operations. The screens used in these upstream operations are often referred to as the "broke" screens where raw material, such as wood cellulose, recycled paper, rags and the like are broken down into fibers.

Initially, stock comprising a slurry of about a 1–4 percent raw fiber material and the balance water composition is prepared. The stock is passed through each of the screening stages to remove contaminants such as plastic, sand, grit, sheaves, splinters, rocks and the like from the stock and leave a usable fiber and water pulp slurry for use in the paper making process.

The screening stages may be arranged as a series of flat screens; however, it is more typical to employ cylinders constructed of screen media. The pulp slurry may be arranged to flow from the outside of the cylinder inward. A more common arrangement is for the pulp slurry to flow from the inside of the cylinder outward. A rotor or other device is generally incorporated into the screen stage. The rotor creates pressure pulses for moving the pulp slurry through the screen media and provides a self-cleaning function.

The majority of screen media for the paper making, pulping processes currently use screens containing parallel filter passages or orifices through which slurry material to be filtered passes. The passages are primarily perpendicular to two parallel planes or sides of screen material defining the inflow and outflow side of the screen media. There are three primary characteristics of the screen media that tend to work against each other: capacity (the throughput of stock), efficiency (the percentage of contaminants filtered out) and runability (the tendency of the screen to blind, mat, or plug). Thus, the designers of the screen media must account for each of these characteristics. Additional requirements for the screen media include sufficient structure on both sides of the passages to prevent breaking of the beams, the screen material between the passages, and to prevent the beams from bending, or warping, which can result in increased, and hence, improper passage size. The screen must also provide a filter slit within each passage each of specific width, typically between about 0.05 millimeter (mm) to 0.7 mm, with a maximum allowable variation of about +/−0.025 mm to optimize capacity, efficiency, and runability.

To manufacture a screen, a metal plate, typically made of stainless steel, thicker than the required final screen thickness is prepared to the appropriate dimensions. For each passage in the screen, a groove, known as the back groove, is cut from what will become the outflow side of the screen. On the inflow side of the screen, a contour cut is made, substantially in alignment with the back groove. The cut depths of the back groove and the contour cut at a center portion thereof leave a proper amount of residual material into which thereafter a slit cut is made. The slit cut results in the creation of a filter slit completely through the residual material through which the slurry to be filtered actually passes during operation. The cut that forms the slit is shorter in length than both the back groove and the contour cut. The fabrication process is repeated for each of the passages to be formed in the screen. When machining is completed, the resultant filter screen may be used as is as a flat screen, or it may rolled or otherwise formed to provide a curvature for use in a cylinder screen.

The most prevalent fabrication technique uses a horizontal mill and a 70 mm milling cutter for each of the above-described cuts. This technique, however, suffers numerous disadvantages as will be described.

A chief drawback of the several drawbacks of milling filter passages in this manner is a resulting limited effective slit length, which is a measure of the length of the slit through which filtering actually takes place, that is less than the actual length of the slit. The horizontal mill uses a radiused cutting tool. While the thickness of the residual plate material near the center portion of the slit can be suitably thin, the residual material becomes substantially thicker at each end and hence is not of uniform thickness. As a result, a portion at each end of the slit does not extend completely through the residual material which significantly shortens the effective slit length to a distance that is less than the actual length of the slit, reducing capacity. Where the slit does extend through the thicker portion of the residual material, the flow of material to be filtered at each end of the slit is greatly reduced or even can be completely be obstructed depending upon slurry boundary layer conditions further reducing capacity. Hence, the effective slit length for a given back groove or contour cut length is substantially reduced thus reducing screen capacity. This unusable portion of the back groove or contour cut where the residual material is thickest along the slit is often referred to as the end margin.

Additional drawbacks of milling include increased stress cracking at the ends of the back groove resulting from the sharp intersection of the slit to the back groove. A reduced amount of material at the back groove slit intersection at the ends also results in localized reduced rigidity of the screen media. Increased processing is also required to remove burrs inherent to the milling process and aggravated by having to use a highly machinable material, such as, for example, 316L or 316 resulphurized steel. There is also limited ability to control slit width because a minimum cutter thickness is required to reduce cutter breakage and to prevent cutter walk, i.e., to preserve straightness while cutting the thicker material. Finally, the overall process results in a less than ideal surface finish.

Because of the foregoing process limitations, subsequent time consuming and costly manual deburring using hand held blades, buffers and polishers is required after milling. Manual deburring often results in improper edge and corner radii and may exacerbate stress cracking problems. Additional operations also include blasting using water or air and an abrasive, electropolishing and plating to obtain a suitable surface finish. These operations can adversely effect slit width, i.e., blasting and polishing may undesirably increase width while plating may undesirably narrow width. All additional processing obviously increases process complexity and product cost.

Thus, there is a need for a screen media that provides enhanced capacity, efficiency and runability yet which is easily fabricated. There is also a need for a screen media that provides increased capacity without adversely effecting efficiency and runability. There is still further a need for a screen media where the resultant effective slit length is about the same as slit length increasing filter capacity.

SUMMARY OF THE INVENTION

A screen media for use in filtering a slurry, that preferably is pulp slurry, has a filter passage that includes a filter slit that extends completely through residual material left by a contour cut in a first screen media side and a back groove in a second screen media side wherein the slit ends are defined by substantially planar end walls made preferably by end milling the slit ends for producing a slit having an effective filtering length that is substantially the same as its actual length. The end walls are preferably generally parallel or slightly obtusely angled relative to the direction of flow slurry flowing through the slit which preferably minimizes any boundary layer of the slurry clinging to the end walls and that portion of an arcuate contour cut in each end margin region adjacent each slit end thereby maximizing effective length. Moreover, the residual material remaining after machining of the slit has been completed is of uniform thickness further helping to increase filter capacity.

During operation, the pulp slurry is fed from one side of the screen media to the other side of the screen media through a plurality of screening passages. Each screening passage includes the contour cut formed in the one side, the back groove formed in the other side, and residual material between the contour cut and the back groove. The slit is formed where an elongate slot in the residual material extends completely through the residual material. During operation, the slurry enters the passage, the slot, and squeezes through the much narrower slit causing the slurry to be desirably filtered.

In accordance with another preferred embodiment of the present invention, a screen media has a plurality of screening passages that each includes a material relief formed in one screen media side. The material relief has a first end wall, a second end wall and a bottom and is preferably formed by a milling operation performed preferably after the slot has been cut forming the slit. The first end wall and said second end wall are substantially perpendicular to the second side, and the bottom is substantially parallel to the second side. The slot configuration also includes a contour cut formed in the first side and aligned with the material relief. A residual material portion remains between the bottom and the contour cut, and a slit is formed where the slot extends completely through the residual material portion.

Objects, features and advantages of the present invention are to make a novel screen media: that increases filter capacity without adversely compromising efficiency or runability; that increases the effective filtering length of the slit through which slurry flows and is filtered such that the effective slit length is the same as or very nearly the same as the actual slit length; which can be cost effectively made using computer numerical control (CNC) machining equipment; which minimizes obstruction to the flow of slurry being filtered through the filter slit of each passage; that can be made from a wide variety of metals including steel, 316L stainless steel, and resulfurized 316 stainless steel; that minimizes the number of post-machining finishing operations saving time and money; that requires only minor automated post-machining finishing, if any such postmachining finishing is even required, saving time, labor and money; that increases the life of the screen media by significantly reducing microcracking and work hardening at the slit ends; that increases the reliability of the screen media by the novel slit geometry reducing stress concentration factors at the slit ends; that reduces saw blade cutting depth improving saw blade side support; that reduces radial saw engagement when cutting the slit; that improves surface finish and reduces burrs because sawing depth is decreased; that permits use of carbide cutters instead of steel cutters; that is accomplished using a method well suited for making new screen media and rebuilding old screen media; that can be accomplished using only a single piece of equipment, namely preferably a CNC machining center; and is a screening media that is rugged, simple, flexible, reliable, and durable, and which is of economical manufacture and is easy to assemble and use.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE INVENTION

1. Introduction

FIGS. 7–22 depict a screen media adapted for use in paper making and pulping processes. The screen media is formed from a plate having an inflow side and an outflow side arranged preferably substantially parallel to each other. A plurality of screening passages through which slurry to be filtered are formed in the plate. Each of the slot-shaped screening passages have an inlet contour formed in the inflow side, a back groove formed in the outflow side, and a slot formed in a residual material portion of the plate that is located between the inlet contour and the back groove. Where the slot extends completely through the residual material it forms a slit through which slurry being filtered actually flows. The inlet contour, the back groove and the slot are arranged to minimize the end margin, and hence, to increase the effective length through which the slurry actually flows thereby increasing the filtering capacity of the screen media. The inlet contour, the back groove and the slot are also arranged to permit more effective control of the slit width to increase efficiency of the screen media. Still further, this novel arrangement of the inlet contour, the back groove, and the slot reduces post machining processing and improves the strength of the screen media by, among other things, relieving stress concentrations.

2. Screening Apparatus

Figure 1:
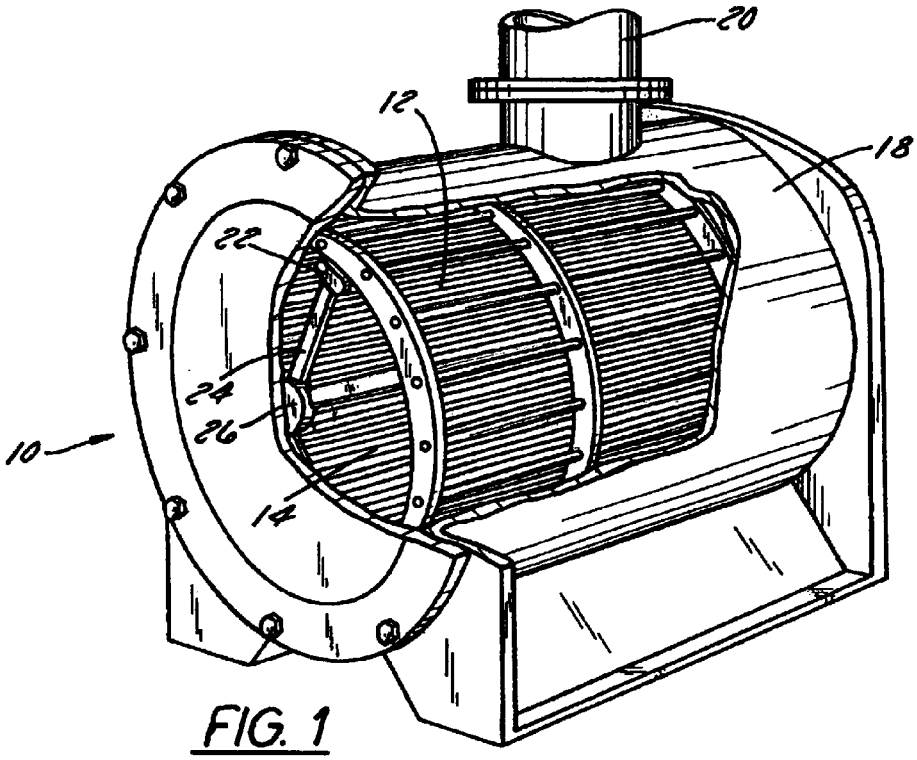
FIG. 1 is a perspective view, with portions broken away, illustrating a screening apparatus including a screen media assembly constructed to include plurality of screen media formed in accordance with a preferred embodiment of the present invention.

Referring to FIG. 1, a screening apparatus 10 adaptable for use with screen media constructed in accordance with the preferred embodiments of the present invention is shown. A screen media assembly 12 defines an interior chamber 14 and an exterior chamber 16. The screen media assembly 12 is enclosed within a housing 18 including a pulp slurry inlet (not shown), a contaminant outlet (not shown) leading from interior chamber 14, and a fiber outlet 20. A pulp slurry to be screened flows into interior chamber 14 from the slurry inlet, is passed through screen media assembly 12 and a slurry of water and accepted fiber flows out through fiber outlet 20. Contaminants such as plastic, sheaves, bark, dirt, grit, sand and other foreign matter are removed through the contaminant outlet. The screen media assembly 12 preferably is stationary within housing 18, and to aid in passing the pulp slurry through the screen media and to help inhibit plugging of the screen media, hydrofoils 22 are mounted for rotation within interior chamber 14.

The hydrofoils 22 are supported on arms 24 of a rotary driven shaft 26 and rotate in a clockwise direction as viewed in FIG. 1. Other mechanisms can be used to help pass slurry through the screen media and to help prevent plugging. For example, bump rotors, lobed rotors, drum rotors, other mechanisms preferably of industry-standard construction, and other mechanisms that preferably are of pulse-type construction can be used.

The screening apparatus 10, including the operative elements thereof, are merely illustrative of a suitable screening apparatus that may benefit from the present invention. The present invention can be used with other screening apparatus. For example, the screen media assembly of this invention can be used with screening apparatus having a screen of solid, one-piece construction or of modular construction. The invention can also be used with screening plates, and other screening devices which may or may not be cylindrical in nature.

Figure 2:
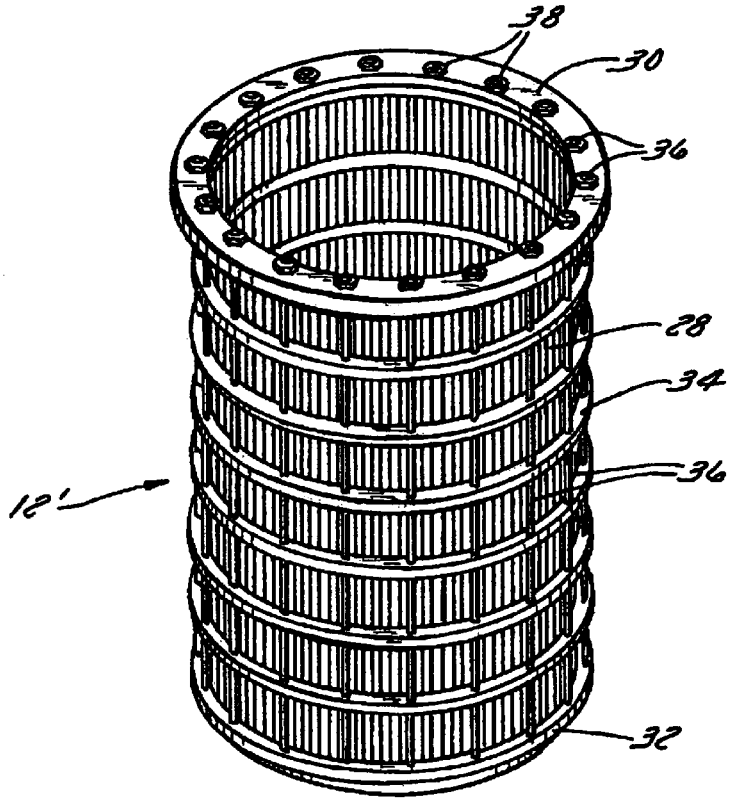
FIG. 2 is a side elevation view of a screen media assembly.

With reference to FIG. 2, a screen media assembly 12' is shown differing from screen media assembly 12 only in that screen media assembly 12' is shown with seven rows of screen media sections, one of which is identified by reference numeral 28, while screen media assembly 12 shown in FIG. 1 has two rows of screen media sections. Screen media assembly 12' is a modular, thick-walled screen media cylinder including a plurality of cylindrical screen media sections 28 supported by end rings 30 and 32 and intermediate support rings, one of which is identified by reference numeral 34. End rings 30 and 32 and intermediate support rings 34 are formed from stainless steel or another suitable alloy and are formed with suitable grooves for supporting screen media sections 28 therein. Axially extending tie rods, one of which is identified by reference numeral 36, are spaced circumferentially about screen media assembly 12' and engage end rings 30 and 32 and intermediate rings 34. Tie rods 36 include a threaded portion at each end thereof, and nuts, one of which is identified by reference numeral 38, are provided for drawing end rings 30 and 32 and intermediate rings 34 together tightly, retaining screen media sections 28 therebetween. A further, and more complete, discussion of a preferred construction for screen media assembly 12' may be found in commonly assigned U.S. patent application Ser. No. 08/897,541, entitled "Modular Screen Cylinder and a Method for its Manufacture," now U.S. Pat. No. 5,954,956, the disclosure of which is hereby expressly incorporated herein by reference.

3. Prior Art Screen Media

Figure 5:
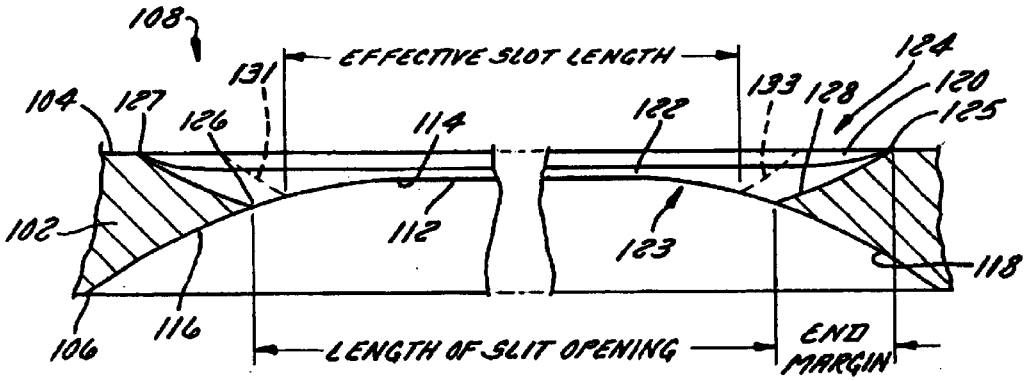
FIG. 5 PRIOR ART
FIG. 5 is a cross-sectional view taken along line 5—5 of FIG. 3.
Figure 3:
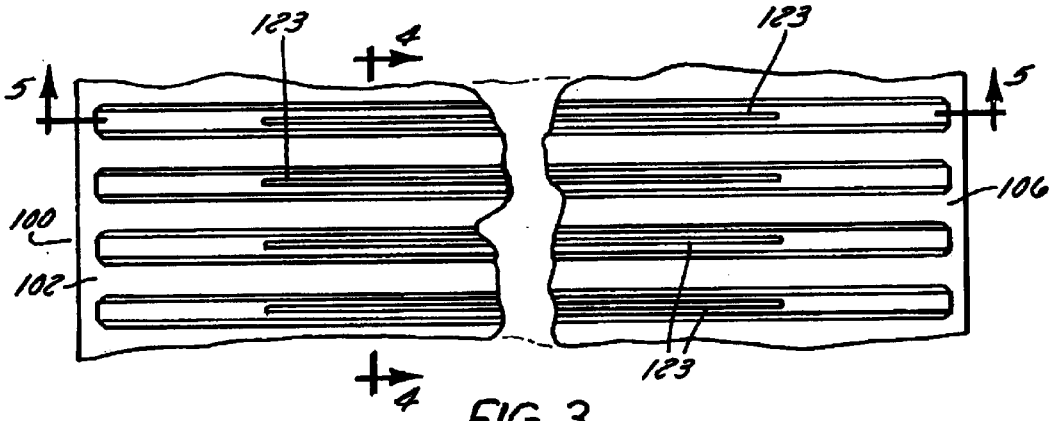
FIG. 3 PRIOR ART
FIG. 3 is a bottom view of a portion of a screen media illustrating a prior art screening passage configuration and appropriately labeled "Prior Art"
Figure 4:
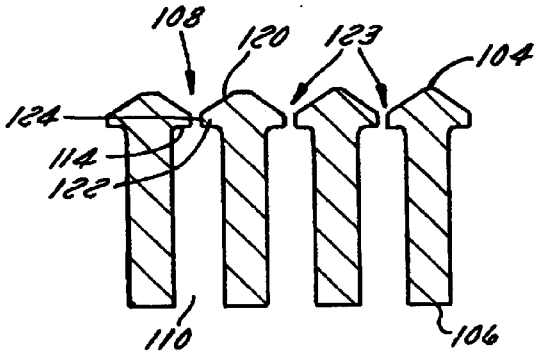
FIG. 4 PRIOR ART
FIG. 4 is a cross-sectional view taken along line 4—4 of FIG. 3.

With reference to FIGS. 3–5, and to provide a framework for the present invention, a screen media 100 constructed in accordance with the prior art is shown. Screen media 100 is formed from an about 8 mm thick plate 102 of 316L or resulphurized 316 steel that defines an inflow side 104 and an outflow side 106. Inflow side 104 is substantially parallel to outflow side 106, and plate 102 also includes a plurality of screening passages 108 formed therein.

More particularly, each screening passage 108 includes a back groove 110 formed in outflow side 106. Back groove 110 is formed to a depth of about 6–6.5 mm using a 70 mm milling cutter. At a center portion 112, a bottom 114 of back groove 110 is substantially parallel to both inflow side 104 and outflow side 106. At ends 116 and 118, respectively, back groove 110 extends along an arc, defined by the diameter of the milling cutter, from bottom 114 to outflow side 106.

Each screening passage 108 further includes a contour cut 120 formed in inflow side 104. Contour cut 120 is shown with a "V" cross-sectional configuration (FIG. 4), but it is known to use other contours that assist the flow of slurry through screening passage 108 while limiting plugging of the passage 108 by contaminants. Contour cut 120 extends approximately 1.0 mm into inflow side 104 defining a residual material portion 122 between back groove 110 and contour cut 120.

The residual material 122 remaining after these operations have been performed has a minimum thickness at center 112 that increases outwardly towards ends 116 and 118. Formed in residual material 122 and extending through center 112 is a slot 124. The slot 124 is also cut using a 70 mm milling cutter from inflow side 104 to an opening length extending between an end 126 and an end 128 thereof defining a slit 123 through which the slurry actually flows. At end 126 and end 128, slot 124 does not extend through residual material 122. Further, immediately adjacent end 126 and end 128, residual material 122 is substantially thicker, on the order of about 1.5–12 times thicker, than at center 112. Moreover, the cut which forms the slot 124 results in the residual material at each outer end 127 of the slot 124 to slit end 126 and outer end 125 and slit end 128 being non-straight or even arc-shaped forming an "end margin" at each end, only one "end margin" which is labeled in FIG. 5.

It is known in these end margin regions, flow of slurry through slit 123 is impeded or nearly completely obstructed. Thus, a region less than the overall "length of slit opening" may be considered as the "effective slot length" through which slurry actually flows and is filtered. The "effective slot length" is the portion of the slot 124 (slit 123) that is actually effective for screening pulp. The residual material between slot end 127 and slit end 126 and slot end 125 and slit end 128 are considered the end margins of each screening passage 108 defining an essentially unusable portion of screening passage 108 that reduces the effective slot length such that it is less than the actual length of the slit 123.

It is believed that the taper of the residual material from slot end 127 to slit end 126 and slot end 125 to slit end 128 entraps a boundary layer 131 and 133 in the end margin regions that extends significantly into the throat of the passage 108, that is, the slit 123, and impedes the flow of slurry through the slit 123 from the inflow side 104 to the outflow side 106. It is further believed that the combination of pressure and velocity of the slurry flowing through the slit 123 in combination with angle of taper of this disadvantageous slot end margin construction reduce the effective length to a length significantly less than the actual length of the slit 123. For example, in actual tests, it has been measured that the effective slot length is approximately 5–15% less than actual slit length reducing filter capacity a like amount.

4. Screen Media in Accordance with the Preferred Embodiments

With reference now to FIGS. 6–10, a screen media 200 in accordance with a preferred embodiment of the present invention is shown. Screen media 200 is formed from a plate 202 approximately 8.0 mm thick of a suitable steel alloy that may be selected for its machinability, but is preferably also selected for its strength and resistance to wear and corrosion. Plate 202 defines an inflow side 204 and an outflow side 206, and inflow side 204 and outflow side 206 are preferably substantially parallel to each other. It will be appreciated that screen media 200 is initially formed in a planar state and may be later formed, such as by rolling, to an arcuate, hoop, or cylinder shape. In this regard, inflow side 204 and outflow side 206 each form a portion of a cylinder wall and preferably remain essentially concentric, i.e., parallel.

Plate 202 includes a plurality of screening passages 205. In a preferred embodiment of the present invention, each screening passage 205 preferably has an identical configuration, and therefore, a typical screening passage 205 is described hereinbelow. Each screening passage 205 includes a back groove 208 formed in outflow side 206 and an inlet contour or contour cut 210 formed in inflow side 204. Contour cut 210 is shown as a "V" groove cut extending about 1.0 mm into plate 202 at a bottom 220 and is preferably formed using a radiused milling cutter. It will be appreciated that other configurations for contour cut 210 adapted for improving slurry flow and inhibiting plugging of screening passages 205 may be used without departing from the fair scope of the present invention.

Back groove 208 is about 1.5 mm wide and is formed using a radiused milling cutter that extends about 6–6.5 mm into plate 202 at a center 212. Back groove 208 includes an end 214 and an end 216 each having a radius substantially defined by the diameter of the milling cutter. Back groove 208 further includes a material relief 222 in the residual material having a first side wall 224, a second side wall 226, a first end wall 228 and a second end wall 230 defining a periphery 232 of material relief 222. Material relief also includes a bottom 218 formed preferably substantially parallel to both inflow side 204 and outflow side 206 and extending from center 212 outwardly to each of first end wall 228 and second end wall 230. Material relief 222 preferably is formed by end milling.

Figure 9:
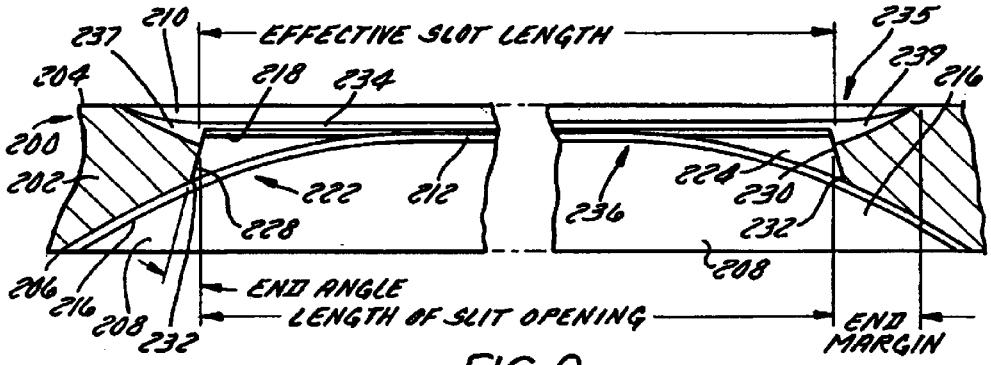
FIG. 9 is a cross-sectional view taken along line 9—9 of FIG. 6.
Figure 7:
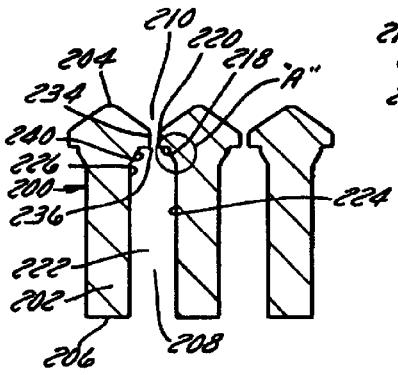
FIG. 7 is a cross-sectional view taken along line 7—7 of FIG. 6.
Figure 8:
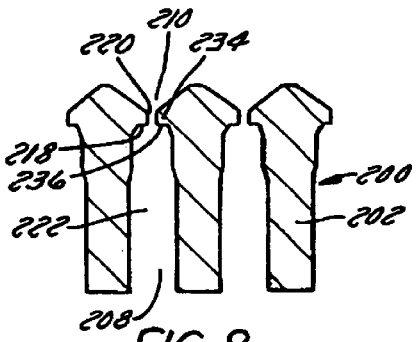
FIG. 8 is a cross-sectional view taken along line 8—8 of FIG. 6.

Bottom 218 and bottom 220 define a residual material portion 234 between back groove 208 and contour cut 210. As best seen in FIGS. 7–9 and as distinguished over the prior art, the residual material 234 has a substantially uniform thickness from first end wall 228 to second end wall 230. Formed in the residual material 234 is a slot 235 that forms a filter slit 236 where it breaks completely through the residual material 234 that extends from first end wall 228 to second end wall 230, and thus, the entire length of bottom 218. Slit 236 is preferably formed from inflow side 204 using a saw cutter. In FIG. 9, the slot 235 is defined by an arcuate trough that extends below the contour cut 210 and through the residual material 234. Each end portion 237 and 239 of the slot 235 is upturned and arcuate due to the round cutter used to form the slot 235.Each slot end portion 237 and 239 also forms an end margin that is not useable for filtering.

The arrangement of back groove 208, contour cut 210, and material relief 222 permits cutting the slot 235 and, hence slit 236, from inflow side 204 with a minimum of saw engagement with plate 202 while cutting. More particularly, the depth of the cut is substantially reduced over the prior art, particularly at end 214 and end 216, since the residual material 234 now has a substantially uniform thickness. Thus, both circumferential and radial saw engagement is reduced. This allows for better saw support, improved cutting action, reduced saw breakage, reduced saw walk, and advantageous use of carbide cutting tools. Slot 235 is also extended slightly into first end wall 228 and second end wall 230 eliminating the highly-convex, sharp intersection that would otherwise exist between slot 235 and back groove 208.

By this advantageous construction, the "effective slot length" is increased over the prior art to be virtually equal to the "length of the slit opening" thereby increasing the filtering capacity of the screen media 200. In other words, by providing material relief 222, and particularly, first end wall 228 and second end wall 230, the end margins of each screening passage 205 are preferably reduced which thereby advantageously increases the slit opening length over the prior art. Furthermore, because residual material 234 is of a substantially uniform thickness for the entire slit opening, there are virtually no portions of slit 236 through which the flow of slurry is inhibited. Hence, unlike the prior art, not only may slit 236 be lengthened, virtually all of slit 236 is effective for screening pulp.

Figure 6:
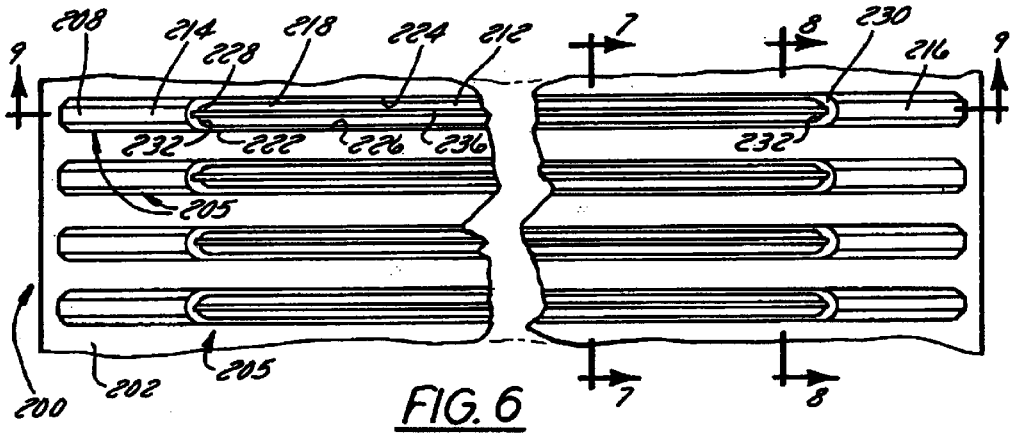
FIG. 6 is a bottom view of a portion of a screen media illustrating a screening passage configuration in accordance with a preferred embodiment of the present invention.
Figure 10:
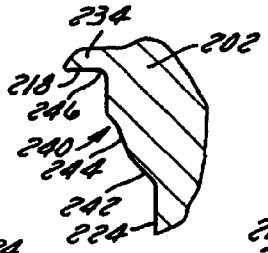
FIG. 10 is an enlarged portion of the cross-sectional view of FIG. 7 of the area enclosed by circle "A"

With continued reference to FIGS. 6–9 and now to FIG. 10, each of first side wall 224, second side wall 226, first end wall 228 and second end wall 230 of material relief 222 are formed substantially perpendicular to outflow side 206. First end wall 228 and second end wall 230 are shown in FIGS. 6 and 9, for illustrative purposes, as having a substantial end angle with respect to perpendicular, however, this angle may be relatively small and range on the order of about 70°–90°. First end wall 228 and second end wall 230 are preferably formed using an end mill cutter removing a small portion or "pick" of material over the course of several passes. The cutter is preferably smaller than the width of back groove 208, and in this manner, material relief 222 may be formed without engaging the side of the cutter, thus advantageously preventing burrs and reducing side forces on the tool.

Material relief 222 also includes a transition surface 240 between each of first side wall 224, second side wall 226, first end wall 228 and second end wall 230, respectively, and bottom 218 (best seen in FIG. 10). It should be noted that first side wall 224 and second side wall 226 are formed when cutting back groove 208 with the milling cutter. Some additional material may be removed from either of first side wall 224 and second side wall 226 when forming material relief 222, but it is preferred to keep this to a minimum. Transition surface 240 is formed to include a first transition contour 242, a second transition contour 244 and a third transition contour 246. First transition contour 242 is a chamfer formed by the milling cutter used to form back groove 208. Second transition contour is preferably a radius formed by the end mill cutter used to form material relief 222, and particularly, to form first end wall 228 and second end wall 230. Third transition contour 246 is a corner radius that may be formed using a deburring end mill. The overall effect of transition surface 240 is to reduce the potential for sharp corners and the resulting potential for stress concentrations arising therefrom. Moreover, each of first transition contour 242, second transition contour 244 and third transition contour 246 are formed using sharp edge cutting tools at high speed and a light chip load. In this manner, virtually all problems associated with manual, "breaking-off" processes such as damage to the adjacent geometry, micro cracking, and work hardening are preferably virtually eliminated. Any burrs remaining after forming material relief 222 and slit 236 will be minor and may be removed by non-aggressive automated processing that can be arranged as part of subsequent surface finishing processes, such as surface finishing using an aluminum oxide blast or the like. Furthermore, elimination of manual processing ensures design corners and radii are maintained so that design flow characteristics are achieved.

With reference now to FIGS. 11–14, a screen media 300 in accordance with another preferred embodiment of the present invention is shown. Screen media 300 is formed from a plate 302 approximately 8.0 mm thick of a suitable steel alloy that may be selected for its machinability, but is preferably selected for its strength and resistance to wear and corrosion. Plate 302 defines an inflow side 304 and an outflow side 306, and inflow side 304 and outflow side 306 are substantially parallel to each other.

Plate 302 includes a plurality of screening passages 305. In a preferred embodiment of the present invention, each screening passage 305 has an identical configuration, and therefore, a typical screening passage 305 is described. Each screening passage 305 includes a back groove 308 formed in outflow side 306 and a contour cut 310 formed in inflow side 304. Contour cut 310 is shown as a "V" groove cut extending about 1.0 mm into plate 302 at a bottom 320 and is preferably formed using a radiused milling cutter.

Back groove 308 is about 1.5 mm wide and is formed using a radiused milling cutter that extends about 6–6.5 mm into plate 302 at a center 312. Back groove 308 includes an end 314 and an end 316 each having a radius defined by the diameter of the milling cutter. Back groove 308 also includes a material relief 322 having a first side wall 324, a second side wall 326, a first end wall 328 and a second end wall 330 defining a periphery 332 of material relief 322. Material relief 322 also includes a bottom 318 formed substantially parallel to both inflow side 304 and outflow side 306 and extending from center 312 outwardly to each of first end wall 328 and second end wall 330.

Figure 14:
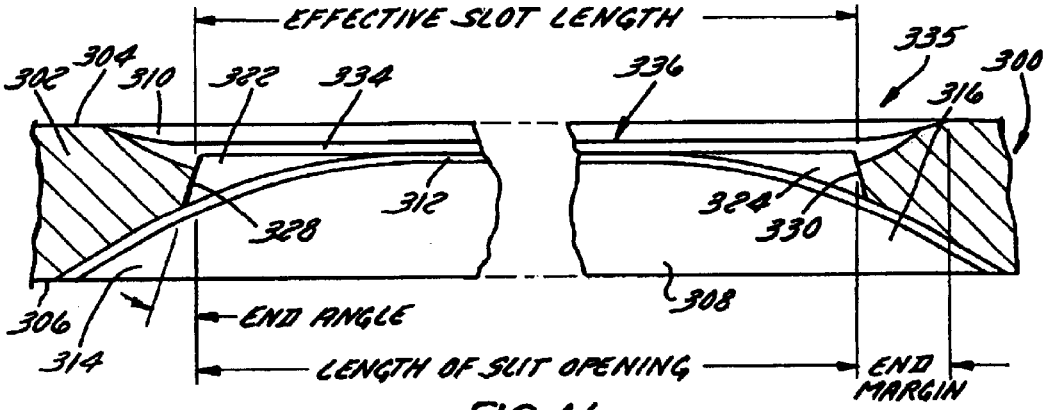
FIG. 14 is a cross-sectional view taken along line 14—14 of FIG. 11.
Figure 12:
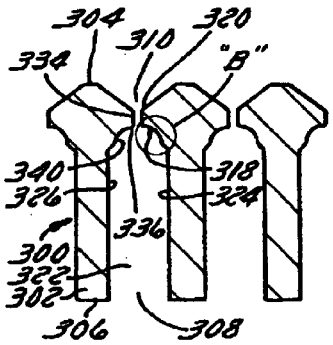
FIG. 12 is a cross-sectional view taken along line 12—12 of FIG. 11.
Figure 13:
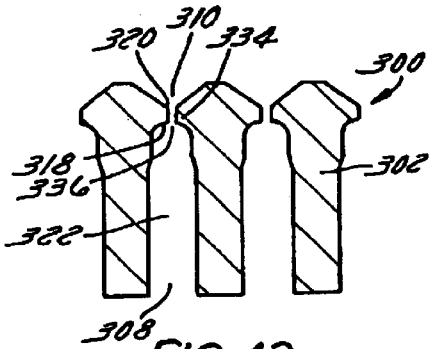
FIG. 13 is a cross-sectional view taken along line 13—13 of FIG. 11.

Bottom 318 and bottom 320 define a residual material portion 334 between back groove 308 and contour cut 310. As best seen in FIGS. 12–14, residual material 334 has a substantially uniform thickness from first end wall 328 to second end wall 330. Formed in and through residual material 334 is a slot 335 that defines a slit 336 also extending from first end wall 328 to second end wall 330, and thus, the entire length of bottom 318. Slot 335 is preferably formed from inflow side 304 using a saw cutter.

In accordance with the preferred embodiment of the invention illustrated, the effective slot length is increased to be virtually equal to the actual length of the slot opening or slit 336, unlike the prior art. In this manner, the capacity of screen media 300 may be substantially increased. In other words, by providing material relief 322, and particularly, first end wall 328 and second end wall 330, the end margins of each slot 335 may be reduced, enabling the length of each slit 336 to be made longer. Furthermore, because residual material 334 is of a substantially uniform thickness for the entire slit opening, there are no portions of slit 336 through which the flow of slurry is inhibited. Hence, not only may slit 336 be lengthened, virtually all of slit 336 is effective for screening pulp.

Figure 11:
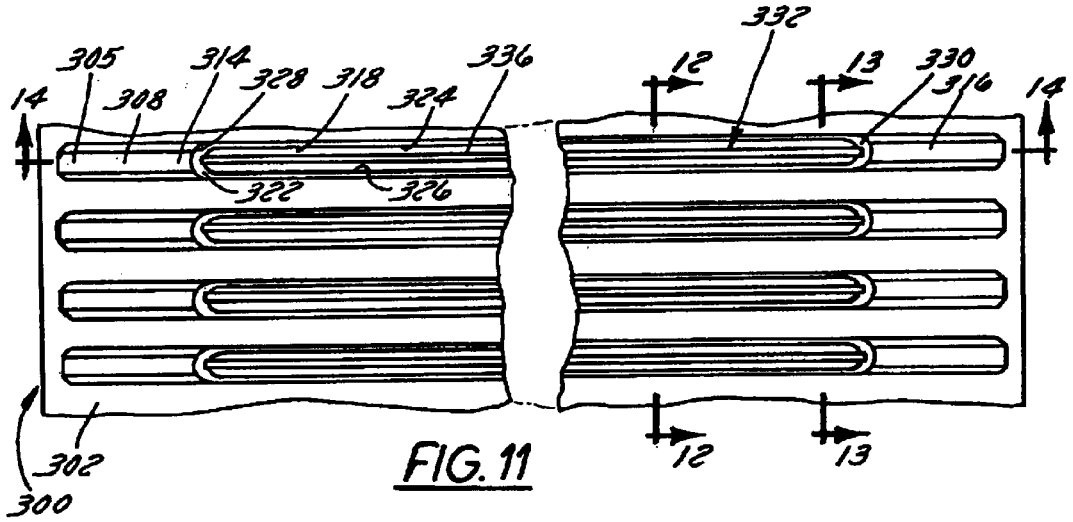
FIG. 11 is a bottom view of a portion of a screen media illustrating a screening passage configuration in accordance with an alternate preferred embodiment of the present invention.
Figure 15:
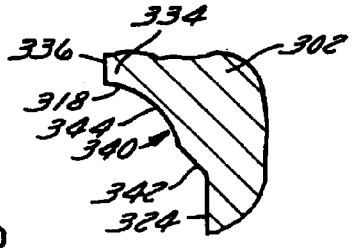
FIG. 15 is an enlarged portion of the cross-sectional view of FIG. 12 of the area enclosed by circle "B"

With continued reference to FIGS. 11–14 and now to FIG. 15, each of first side wall 324, second side wall 326, first end wall 328 and second end wall 330 of material relief 322 are formed substantially perpendicular to outflow side 306. First end wall 328 and second end wall 330 are shown in FIGS. 11 and 14, for illustrative purposes, as having a substantial end angle with respect to perpendicular, however, this angle is maintained relatively small and range on the order of about 70°–90°. First end wall 328 and second end wall 330 are preferably formed using an end mill cutter removing a small portion or "pick" of material over the course of several passes. The cutter is preferably smaller than the width of back groove 308, and in this manner, material relief 322 may be formed without engaging the side of the cutter, thus preventing burrs and reducing side forces on the tool.

Material relief 322 also includes a transition surface 340 between each of first side wall 324 and second side wall 326 and bottom 318 (best seen in FIG. 15). Transition surface 340 is formed to include a first transition contour 342 and a second transition contour 344. First transition contour 342 is a chamfer formed by the milling cutter used to form back groove 308. Second transition contour is preferably a radius formed by the end mill cutter used to form material relief 322, and particularly, to form first end wall 328 and second end wall 330. The overall effect of transition surface 340 is to reduce the potential for sharp corners and the resulting potential for stress concentrations arising therefrom. Moreover, each of first transition contour 342 and second transition contour 344 are formed using sharp edge cutting tools at high speed and a light chip load. In this manner, virtually all problems associated with manual, "breaking-off" processes such as damage to the adjacent geometry, micro cracking and work hardening are eliminated. Thus, transition surface 340 advantageously eliminates any sharp corner radii that may lead to stress concentration cracking.

5. Other Preferred Transition Surface Configurations

Figure 16:
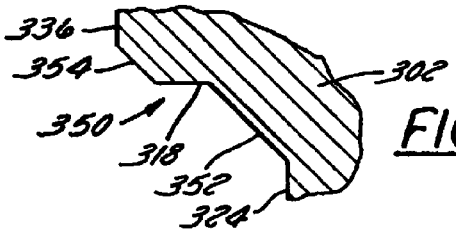
FIG. 16 is a lateral cross-sectional view illustrating a screening passage configuration in accordance with a second preferred embodiment of the present invention.

There are numerous possible arrangements for transition surface 340. With respect to screen media 300, several alternate arrangements are shown with reference to FIGS. 16–20. It will be appreciated that the arrangements shown have equal application to screen media 200. In FIG. 16, a transition surface 350 is shown formed between first side wall 324 and bottom 318. Transition surface 350 includes a first transition contour 352 and a second transition contour 354. First transition contour is the chamfer formed by the milling cutter while making back groove 308. Second transition contour is preferably a chamfer formed by a disk deburring cutter between slit 336 and bottom 318. Use of disk deburring tool, while not providing as substantial an improvement in effective slot length, significantly increases process efficiency for forming screening passages 305.

Figure 17:
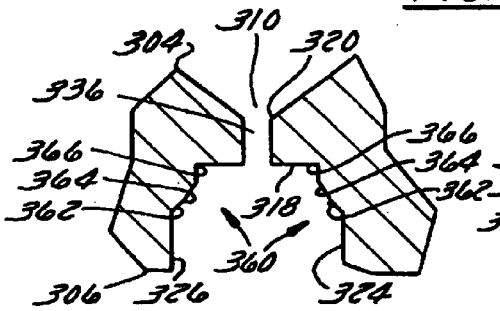
FIG. 17 is a lateral cross-sectional view illustrating a screening passage configuration in accordance with the second preferred embodiment of the present invention.

In FIG. 17, a transition surface 360 is formed between each of first side wall 324 and bottom 318 and second side wall 326 and bottom 318. Each transition surface 360 includes a first transition contour 362, a second transition contour 364 and a third transition contour 366. First transition contour is the chamfer formed by the milling cutter while making back groove 308. Second transition contour is preferably a radius formed by the end mill cutter used to form material relief 322. Third transition contour is a corner radius formed by a deburring end mill cutter.

Figure 18:
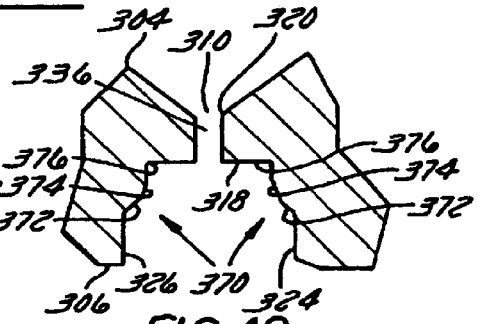
FIG. 18 is a lateral cross-sectional view illustrating a screening passage configuration in accordance with the second preferred embodiment of the present invention

In FIG. 18, a transition surface 370 is formed between each of first side wall 324 and bottom 318 and second side wall 326 and bottom 318. Each transition surface 370 includes a first transition contour 372, a second transition contour 374 and a third transition contour 376. First transition contour 372 is the chamfer formed by the milling cutter while making back groove 308. Second transition contour 374 is preferably a chamfer formed by the end mill cutter used to form material relief 322. Third transition contour 376 is a corner radius formed by a deburring end mill cutter.

Figure 19:
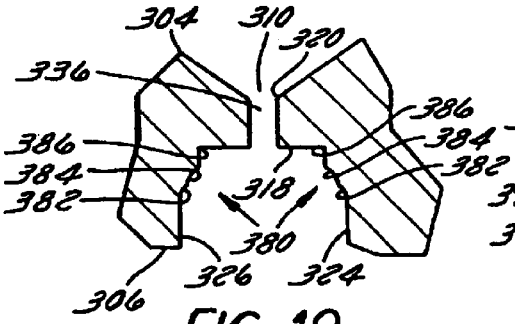
FIG. 19 is a lateral cross-sectional view illustrating a screening passage configuration in accordance with the second preferred embodiment of the present invention

In FIG. 19, a transition surface 380 is formed between each of first side wall 324 and bottom 318 and second side wall 326 and bottom 318. Each transition surface 380 includes a first transition contour 382, a second transition contour 384 and a third transition contour 386. First transition contour 382 is preferably a radius formed by the milling cutter while making back groove 308. Second transition contour 384 is preferably a radius formed by the end mill cutter used to form material relief 322. Third transition contour 386 is a corner radius formed by a deburring end mill cutter.

Figure 20:
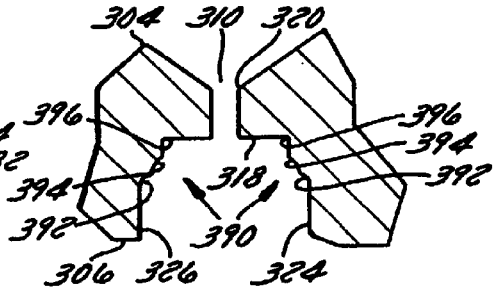
FIG. 20 is a lateral cross-sectional view illustrating a screening passage configuration in accordance with the second preferred embodiment of the present invention

In FIG. 20, a transition surface 390 is formed between each of first side wall 324 and bottom 318 and second side wall 326 and bottom 318. Each transition surface 390 includes a first transition contour 392, a second transition contour 394 and a third transition contour 396. First transition contour 392 is preferably a radius formed by the milling cutter while making back groove 308. Second transition contour 394 is preferably a radius formed by the end mill cutter used to form material relief 322. Third transition contour 396 is a corner radius formed by a deburring end mill cutter.

The various contours of each of transition surfaces 350, 360, 370, 380 and 390 are formed using sharp edge cutting tools at high speed and a light chip load. In this manner, virtually all problems associated with manual, "breaking-off" processes such as damage to the adjacent geometry, micro cracking and work hardening are eliminated. As will be appreciated, the various configurations are easily adaptable to available cutting tool technology, and or to cutting tools more suitably adapted for forming, for example, back groove 308 and material relief 322.

6. Other Preferred End Wall Configurations

Figure 21:
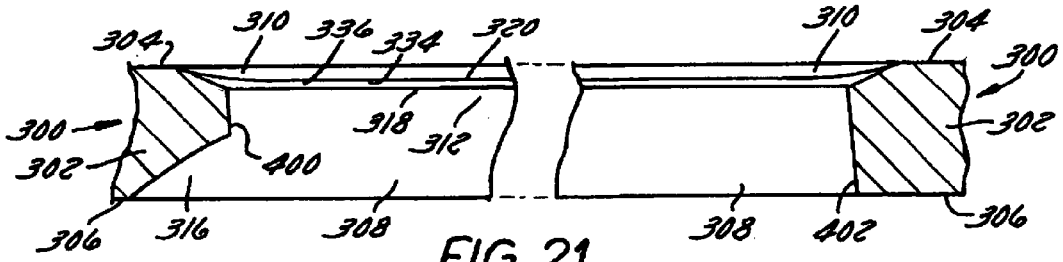
FIG. 21 is a longitudinal cross-sectional view illustrating a screening passage configuration in accordance with the second preferred embodiment of the present invention.
Figure 22:
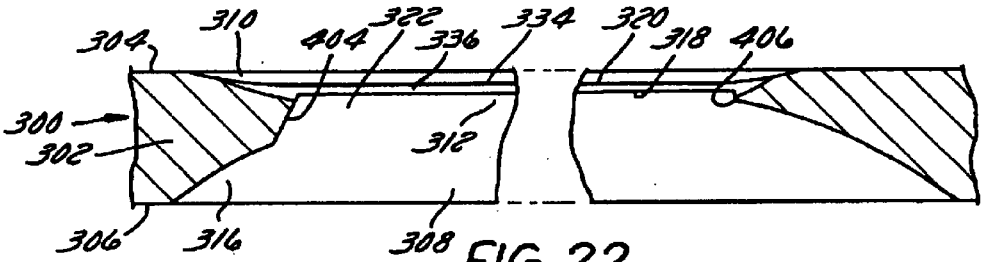
FIG. 22 is a longitudinal cross-sectional view illustrating a screening passage configuration in accordance with the second preferred embodiment of the present invention.

Several alternative end wall arrangements of the material relief in accordance with preferred embodiments of the present invention are shown in FIGS. 21 and 22. It will be appreciated that the arrangements shown have equal application to screen media 200. As seen in FIG. 21, an end wall 400 of material relief 322 is arranged at approximately 90° to outflow side 306. End wall 400 is further arranged to shorten the end margin, and as such, increase the effective slit length. Also seen in FIG. 21 is end wall 402 arranged at approximately 85° degrees to outflow side 306. End wall 402 is further arranged so that a minimal amount of the end margin remains. While the arrangement of end wall 402 requires additional machining in order to form material relief 322, the result is a substantial increase in effective slit length.

With reference to FIG. 22, an end wall 404 is arranged at a shallow angle of about 75° to outflow side 306. Shallowing the angle of end wall 404 provides additional area in which to manipulate the end mill cutter used to form material relief 322, and thus, end wall 404. In this manner, shorter and therefore stronger end mill tools may be used and engagement of the cutter side with the end wall being formed is avoided. With continued reference to FIG. 22, an end wall 406 is formed leaving a larger end margin. Forming end wall 406 requires removal of substantially less material than, for example, end wall 402. However, the effective slight length is only marginally increased. More importantly, however, for each of the preferred end wall configurations shown herein post processing to remove burrs, and particularly manual deburring operations, are virtually eliminated.

7. Production of Screen Media

Referring once again to FIGS. 6–10, screen media 200 incorporating screening passages 205 in accordance with the preferred embodiments of the present invention are preferably produced as follows. A suitable plate stock 202 is selected. As noted above, the plate stock is a steel alloy material that may preferably be selected for strength, toughness and corrosion resistance primarily and for machinability secondarily. Typical plate stock can be, for example, 316 stainless steel or the like. The plate stock 202 is generally rectangular having appropriate length and width dimensions for the desired application and having a thickness of approximately 8 mm, but can be thicker or thinner if desired.

Using a radiused mill cutter, such as a 70 mm radius saw cutter with an approximately 1.5 mm blade thickness, a plurality of back grooves 208 are formed in a surface 206 of the plate stock 202. At the center 212 of each back groove 208, the cut is approximately 6–6.5 mm into the plate 202. At the ends 214 and 216 of each back groove 208 exists a radius, substantially equal to the radius of the saw cutter, extending from the bottom 218 of the back groove 208 to the surface 206. The back grooves 208 are arranged substantially parallel to one another and are approximately the width of the plate stock 202 in length while allowing for a sufficient portion of plate stock 202 at the edges of the array of back grooves 208 for securing the plate stock 202 to a screen media assembly 12 (FIG. 1).

Using an end mill cutter, a material relief 222 is formed in each back groove 208. To form the material relief 222, material from the radiused portions of the back groove ends 214 and 216 is removed forming end walls 228 and 230. Material may also be removed from the side walls 224 and 225 of the back groove 208, however, it is preferred to remove a minimal amount, if any, material from the side walls 224 and 226. Each end wall 228 and 230 is preferably formed substantially perpendicular to the surface of the plate stock 202 or with a small angle thereto. Each end wall 228 and 230 is preferably formed at an angle that can vary between about 75° to about 90° so as to maximize effective slit length so it is essentially the same as actual slit length. each material relief 222 also preferably includes a transition surface 240 between each of the end walls 228 and 230 and a bottom 218 and between first and second side walls 224 and 226 and the bottom 218. The transition surfaces 240 preferably includes at least one radiused or chamfered surface 242 and/or 244 and preferably a compound transition surface including two or more radiused or chamfered surfaces 242 and 244 are formed. Forming a material relief 222 in this manner provides a substantially flat bottom surface 218 that is substantially parallel to the outer surface 206 and a transition surface 240 from the bottom 218 to the end walls 228 and 230 and from the bottom 218 to the side walls 224 and 226 in each back groove 208.

Next, a plurality of contour inlets 210, or contour cuts 210, are formed in the other outer surface 204 of the plate 202. Each contour cut 210 is arranged in substantial alignment with each back groove 208. The contour inlet 210 is formed using a radius cutter having an appropriate contour. A preferred contour is a "V" shaped contour, although it will be appreciated that other contours may be used to enhance or otherwise modify flow characteristics of the screening passage 205. The contour cut 210 is made to a depth of about 1.0 mm at its bottom. Thus, the contour cut 210 defines a region of residual material 234 between the bottom of its cut 210 and the bottom of the back groove 208.

The screening passage 205 is completed by forming a slot 235 through the residual material 234 for each contour cut 210 and corresponding back groove 208. Where the slot 235 extends completely through the residual material 234, it forms the slit 236. The slot 235 is formed from the first surface 204, i.e., through the residual material 234 from the bottom of the contour cut 210 through the bottom of back groove 208, using a slitting saw having an appropriate blade thickness. Typical blade thickness is on the order of 0.05–0.7 mm. Some minor deburring and surface finishing, if desired, may then be thereafter performed. For example, it may be desirable to provide a blasted surface finish using an aluminum oxide, or similar abrasive material, blast. Blasting using an abrasive material is also effective for removing the minor burrs, if any, that may be generated during the cutting and milling processes without altering the corner radii, edges and slit width of the screening passage 205.

It should be noted that other machining processes can be used to produce the aforementioned cuts resulting in the novel filter passages disclosed herein. For example, grinding, water jet cutting, laser cutting, electrical discharge machining (EDM), electrical discharge grinding, electrochemical machining and grinding and electron beam cutting and machining can all be used for one or more of the aforementioned cuts.

It should be further noted that the novel screen passage manufacturing methods disclosed herein can also be used to rebuild screen media, including prior art screen media, so as to impart to the screen media novel filter slits having increased effective length and increased actual length. In rebuilding the screen media, an additional end milling operation is performed to impart to the slot 236 the material relief 222 in the form of generally planar end walls 228 and 230 and side walls 224 and 226 of the construction shown in FIGS. 6–10. Of course, the end milling operation can be performed to impart the slit configurations shown in FIGS. 11–22, if desired.

8. Use and Operation

Screen media formed in accordance with the present invention are installed in screen media assemblies 12 that are installed into exemplary screening apparatus 10. In the case of cylindrical screen media assemblies 12, the screen media 200 is first formed, such as by rolling, to an appropriate arcuate shape. The screen media 200 may be attached to the screen media assembly 12 by welding but is more preferably fastened to the screen media assembly 12 using a clamping arrangement such as shown in the aforementioned U.S. patent application Ser. No. 08/897,541. Within the screening apparatus 10, a slurry containing pulp to be screened is feed to the screen media assembly 12 and caused to be passed through the screening passages 205 contained therein. The screening passages 205 act to separate usable fiber from contaminants within the pulp. The usable fiber is carried from the screening apparatus 10 through a fiber outlet 20 and screened contaminants are removed from the screen media assembly 12 via a contaminant outlet. Several stages of screening may be employed as desired to obtain a desired consistency and purity of fiber.

As pulp is being screened, it flows from the plate inflow side 204 through the slits 236 of the screening passages 205 toward the plate outflow side 206. By providing material relief 222 at each end of each slit 236 along with planar end walls 228 and 230 that are generally parallel to the flow of pulp slurry being filtered, the boundary layer of the pulp slurry in the vicinity of each end margin is minimized advantageously increasing the effective slot length and filtering capacity. By this novel and advantageous filter passage construction, each slit 236 can also be made longer relative to the overall length of the contour cut 210 and back groove 208 further increasing filter capacity.

Many changes and modifications could be made to the invention without departing from the fair scope and spirit thereof. The scope of some changes is discussed above. The scope of others will become apparent from the appended claims.

We claim:

1. A method of making a screen media comprising the steps of:

providing a plate stock, the plate stock having a generally planar first surface, a generally planar second surface and a thickness;

forming in said second surface a plurality of back grooves;

forming a material relief in each of said plurality of back grooves, each said material relief defining a first end wall, a second end wall and a bottom, each of said first end wall and said second end wall arranged substantially perpendicular to said second surface and the bottom arranged substantially parallel to said second surface;

forming in said first surface a plurality of contour cuts, each said contour cut arranged in substantial alignment with a corresponding one of said plurality of back grooves, each said contour cut having a bottom defining a residual material between said first surface and said second surface; and forming a slit through said residual material.

2. The method of claim 1, wherein said step of forming a material relief comprises forming a transition surface between each said first end wall and said second end wall and said bottom.

3. The method of claim 1, wherein said step of forming a material relief comprises forming a transition surface between said bottom and a first side wall and a second side wall of each said back groove.

4. The method of claim 3, wherein said step of forming a material relief comprises removing a portion of material from at least one of said first side wall and said second side wall of each said back groove.

5. The method of claim 3, wherein said step of forming a transition surface comprises forming at least one of a corner, a radius and a chamfer.

6. The method of claim 1, wherein said step of forming a material relief comprises using an end mill to remove a portion of material from each said back groove.

7. The method of claim 1, wherein each said first end wall and said second end wall are formed at an angle of about 70 degrees to about 90 degrees with respect to the second surface.

8. The method of claim 1 comprising the step of assembling said screen media into a screen media assembly.

9. The method of claim 1 comprising the step of forming said screen media into an arcuate shape.

10. The method of claim 9 comprising the step of assembling said screen media into a cylindrical screen media assembly.

11. The method of claim 10, wherein said cylindrical screen media assembly has an inflow side and an outflow side, said first surface of said screen media is disposed toward said inflow side, and said second surface is disposed toward said outflow side.

12. The method of claim 7 wherein said first end wall and said second end wall are each inclined at an angle that is less than 90 degrees relative to perpendicular such that said first end wall is inclined in a direction toward an edge of said plate stock and toward an outflow side of said screen media, and said second end wall is inclined in a direction toward an opposite edge of said plate stock and toward said outflow side of said screen media.

13. The method of claim 1 wherein forming said plurality of back grooves is done by cutting.

14. The method of claim 13 wherein said cutting said plurality of said back grooves is done by radiused milling cutting.

15. The method of claim 1 wherein forming said plurality of contour cuts is done by cutting.

16. The method of claim 15 wherein said cutting said plurality of said contour cuts is done by radiused milling cutting.

17. The method of claim 15 wherein each one of said plurality of contour cuts forms a V-shaped groove in said plate stock.

18. The method of claim 1 wherein forming each said material relief is done by end milling in each one of said plurality of back grooves.

19. A method of making a screen for a screen cylinder that filters or screens pulp or fabric fiber in slurry, the method comprising the steps of:

providing a plate, the plate having a generally planar first surface, a generally planar second surface and a thickness;

forming in the second surface a plurality of back grooves;

forming a material relief in each of the plurality of back grooves;

forming in the first surface a plurality of contour cuts, each contour cut arranged in substantial alignment with a corresponding one of said plurality of back grooves, each contour cut having a bottom defining a residual material between the first surface and the second surface;

forming a slit through each residual material; and wherein each material relief defines a first end wall, a second end wall, and a bottom wall, each of the first end wall and the second end wall are arranged substantially perpendicular to the second surface, and the bottom wall is arranged substantially parallel to the second surface.

20. The method of claim 19 wherein the first end wall and the second end wall of each material relief are disposed at an angle of between about 70° and about 90° relative to the second surface.

21. The method of claim 20 wherein each material relief is further defined by a first sidewall that extends parallel to the slit and a second sidewall that extends parallel to the slit wherein the first sidewall and the second sidewall are arranged substantially perpendicular to the second surface.

22. The method of claim 21 wherein the forming of at least one of the transition surfaces comprises forming a first transition contour comprising a chamfer disposed adjacent one of the material relief sidewalls, forming a second transition contour comprising a radius, and forming a third transition contour comprising a corner radius that is disposed adjacent the slit.

23. The method of claim 22 wherein the corner radius extends from the material relief bottom adjacent the slit to the second transition contour.

24. The method of claim 21 wherein the forming of at least one of the transition surfaces comprises forming a first transition contour that comprises a chamfer that is disposed adjacent one of the material relief sidewalls and forming a second transition contour that comprises a radiused surface that extends to one of the slit sidewalls.

25. The method of claim 24 wherein forming of the radiused surface of the second transition contour removes at least a portion of the material relief bottom at or adjacent the second transition contour.

26. The method of claim 21 wherein each slit is defined by a pair of spaced apart and generally parallel slit sidewalls with the forming of at least one of the transition surfaces comprises forming a first transition contour that extends from one of the material relief end walls to the material relief bottom and a second transition contour that extends from the material relief bottom to one of the sidewalls of the slit.

27. The method of claim 21 further comprising the step of deburring in the region of the transition surfaces wherein the forming of at least one of the transition surfaces comprises forming a first transition contour disposed adjacent one of the material relief sidewalls that comprises a chamfer that is formed during the forming of the back groove, a second transition contour that comprises a radius that is formed during the forming of the material relief, and a third transition contour that comprises a corner radius that is formed during deburring.

28. The method of claim 21 further comprising the step of deburring in the region of the transition surfaces wherein the forming of at least one of the transition surfaces comprises forming a first transition contour disposed adjacent one of the material relief sidewalls that comprises a chamfer that is formed during the forming of the back groove, a second transition contour that comprises a chamfer that is formed during the forming of the material relief, and a third transition contour that comprises a corner radius that is formed during deburring.

29. The method of claim 21 further comprising the step of deburring in the region of the transition surfaces wherein the forming of at least one of the transition surfaces comprises forming a first transition contour disposed adjacent one of the material relief sidewalls that comprises a radius that is formed during the forming of the back groove, a second transition contour that comprises a radius that is formed during the forming of the material relief, and a third transition contour that comprises a corner radius that is formed during deburring.

30. The method of claim 21 further comprising the step of deburring in the region of the transition surfaces wherein the forming of at least one of the transition surfaces comprises forming a first transition contour disposed adjacent one of the material relief sidewalls that comprises a radius that is formed during the forming of the back groove, a second transition contour that comprises a radius that is formed during the forming of the material relief, and a third transition contour that comprises a corner radius that extends to the bottom of the material relief and which is formed during deburring.

31. The method of claim 19 wherein the residual material has a substantially uniform thickness along the length of the slit.

32. The method of claim 31 wherein each substantially aligned contour cut, back groove, and slit define a screen slot that has an effective length that is substantially the same as the length of the slit.

33. The method of claim 19 wherein, for each material relief, one of the material relief end walls is longer than another one of the material relief end walls.

34. The method of claim 33 wherein the longer one of the material relief end walls extends to the second surface.

35. A method of making a screen for a screen cylinder that filters or screens a fibrous slurry, the method comprising the steps of:

(a) providing a plate stock, the plate stock having an inflow surface, an outflow surface and a thickness;

(b) forming in the outflow surface a plurality of back grooves;

(c) forming a material relief in each of the plurality of back grooves, each material relief defined by a first end wall and a second end wall;

(d) forming in the inflow surface a plurality of contour cuts, each contour cut arranged in substantial alignment with a corresponding one of the plurality of back grooves, each contour cut having a bottom defining a residual material between the inflow surface and the outflow surface; and thereafter (e) forming a slit in the residual material.

36. A method of making a screen for a screen cylinder that filters or screens a fibrous slurry, the method comprising the steps of:

providing a plate of metal stock, the plate metal stock having an inflow side on one side, an outflow side on the opposite side, and a thickness;

forming in the outflow side a plurality of back grooves using a cutter;

forming a material relief in each of the plurality of back grooves by end milling, each material relief defining a first end wall, a second end wall and a bottom, each of the first end wall and the second end wall arranged substantially perpendicular to the second surface and the bottom arranged substantially parallel to the second surface;

forming in the inflow side a plurality of contour cuts using a cutter, each contour cut arranged in substantial alignment with a corresponding one of the plurality of back grooves, each contour cut having a bottom defining a residual material between the first surface and the second surface; and forming a slit through the residual material from the inflow side.

37. The method according 36 wherein the residual material between each substantially aligned back groove and contour cut has a substantially uniform thickness from the first end wall to the second end wall.

38. The method of claim 36 wherein the residual material is formed before the slit is cut.

39. The method of claim 36 wherein a slot is defined by each substantially overlapping back groove, contour cut and slit, the slot having an effective filtering or screening length, and the effective filtering or screening length of each slot being substantially the same as the actual length of the slit of the slot.

40. The method of claim 1 further comprising the step of imparting a curve to the plate stock after forming said back grooves, after forming said material relief, after forming said contour cuts, and after forming said slit.

41. The method of claim 1 further comprising the step of forming a slot in each said residual material that forms said slit where said slot breaks completely through said residual material.

42. The method of claim 35 wherein the step of forming a slit in the residual material in step (e) is performed by forming a slot in the residual material with the slit being defined where the slot breaks completely through the residual material.

43. The method of claim 35 wherein the plurality of back grooves, the plurality of contour cuts, and the slit are formed using a single CNC machine.

44. The method of claim 35 wherein forming the material relief produces a residual material having a substantially uniform cross sectional thickness substantially the length of the slit and the slit has an effective length that is substantially the same as the actual length of the slit.

45. The method of claim 35 wherein the end walls of the material relief are flat and the first end wall defines one end of the slit and the second end wall defines the other end of the slit.

46. A method of forming a screening slot in a screen that filters or screens fibrous slurry, the method comprising the steps of:

(a) providing a plate stock that has an inflow surface and an outflow surface;

(b) forming a back groove in the outflow surface;

(c) forming a material relief in the back groove;

(d) forming a contour inlet in the inflow surface in line with the back groove and defining residual material between the inflow surface and the outflow surface; and (e) forming a slot in the residual material wherein a screening slit is formed in the residual material where the slot breaks completely through the residual material.

47. The method of claim 46 wherein steps (b), (c), (d) and (e) are performed in the order recited.

48. The method of claim 46 wherein forming the material relief produces a residual material having a uniform cross sectional thickness along the length of the slit and the slot has an effective slot length that is substantially the same as the actual length of the slit.

49. The method of claim 46 wherein forming the material relief defines a plurality of spaced apart end walls such that one of the end walls defines one end of the slit and the other one of the end walls defines the other end of the slit.

50. The method of claim 46 wherein during step (d) a radiused cutter forms a contour inlet having a V-shaped cross sectional contour.

51. A method of forming a screening slot in a screen that filters or screens fibrous slurry, the method comprising the steps of:

(a) providing a plate stock that has an inflow surface, an outflow surface, and a cross sectional thickness;

(b) cutting a back groove in the outflow surface;

(c) end milling a material relief in a direction parallel to the back groove with the material relief having a pair of end walls;

(d) cutting a contour cut in the inflow surface in line with the back groove and defining residual material between the inflow surface and the outflow surface; and (e) cutting a slot in the residual material thereby forming a screening slit in the residual material that extends through the residual material where the slot breaks through the residual material.

52. A method of forming a screening slot in a screen that filters or screens fibrous slurry, the method comprising the steps of:

(a) providing a plate stock that has an inflow surface, an outflow surface, and a cross sectional thickness;

(b) forming a back groove in the outflow surface having a depth of between six and six and one-half millimeters;

(c) forming a material relief in a direction parallel to the back groove with the material relief having a pair of end walls disposed at an angle relative to one of the inflow surface and the outflow surface of between 70° and 90°;

(d) forming a contour inlet having a V-shaped cross sectional contour in the inflow surface in line with the back groove with the contour inlet having a depth of about one millimeter and defining residual material between the inflow surface and the outflow surface; and (e) forming a slot in the residual material using a cutter having a thickness of between 0.05 and 0.7 millimeter and forming a screening slit in the residual material that extends through the residual material where the slot breaks through the residual material.

53. A method of forming a screening slot in a screen that screens fibrous slurry, the method comprising the steps of:

(a) providing a plate stock that has an inflow surface and an outflow surface;

(b) forming a back groove in the outflow surface;

(c) forming a material relief in a direction parallel to the back groove with the material relief being defined by a surface parallel to one of the inflow surface and the outflow surface and a pair of end walls disposed at an angle relative to one of the inflow surface and the outflow surface and that angle away from each other such that outlet edges of each end wall that are disposed toward the outflow surface are spaced farther apart from each than inlet edges of each end wall that are disposed toward the inflow surface;

(d) forming a contour inlet having a generally V-shaped cross sectional contour in the inflow surface in line with the back groove and defining residual material between the back groove and the contour inlet;

(e) forming a slit in the residual material that extends through the residual material;

(f) wherein the residual material has a substantially uniform thickness substantially along the length of the slit; and (g) wherein during screening of fibrous slurry, the fibrous slurry flows through the contour inlet, the screening slit, and then the back groove with the screening slit permitting selective passage of fiber therethrough.

54. The method of claim 53 comprising the further step of imparting a curve to the plate before step (g).

55. The method of claim 53 wherein the back groove formed in step (b) is defined by a pair of spaced apart and parallel sidewalls and a bottom wall, and wherein forming the material relief in step (c) creates a transition surface between the sidewalls and the bottom wall.

56. The method of claim 53 wherein the transition surface comprises a chamfer or radiused surface.

* * * * *